US008261502B2

(12) United States Patent
Andersen

(10) Patent No.: US 8,261,502 B2
(45) Date of Patent: Sep. 11, 2012

(54) TOWER FOUNDATION SYSTEM

(75) Inventor: Anders Moller Andersen, Lokken (DK)

(73) Assignee: Illinois Tool Works, Inc., Glenview, IL (US)

( * ) Notice: Subject to any disclaimer, the term of this patent is extended or adjusted under 35 U.S.C. 154(b) by 398 days.

(21) Appl. No.: 11/908,569

(22) PCT Filed: Mar. 16, 2006

(86) PCT No.: PCT/DK2006/000152

§ 371 (c)(1),
(2), (4) Date: Mar. 14, 2008

(87) PCT Pub. No.: WO2006/097108

PCT Pub. Date: Sep. 21, 2006

(65) Prior Publication Data

US 2008/0236075 A1 Oct. 2, 2008

(30) Foreign Application Priority Data

Mar. 16, 2005 (DK) ..... 2005 00383

(51) Int. Cl.
*E02D 27/00* (2006.01)

(52) U.S. Cl. ..... 52/297; 52/296; 52/298

(58) Field of Classification Search ..... 52/40, 294, 52/295, 296, 297, 298, 299, 745.17, 223.4, 52/169.9, 170, 223.13, 649.3, 649.6, 704, 52/706; 416/DIG. 6; 174/45 R; 343/874; 248/519, 523, 524; 405/229

See application file for complete search history.

(56) References Cited

U.S. PATENT DOCUMENTS

| | | | | | |
|---|---|---|---|---|---|
| 634,672 | A | * | 10/1899 | Perry | 52/295 |
| 684,044 | A | * | 10/1901 | Commons | 52/295 |
| 878,230 | A | * | 2/1908 | Orr | 52/297 |
| 897,417 | A | * | 9/1908 | Self | 52/166 |
| 1,006,309 | A | * | 10/1911 | Spickerman | 238/265 |
| 1,096,737 | A | * | 5/1914 | McMahan | 52/244 |
| 1,291,823 | A | * | 1/1919 | Fuller | 52/40 |
| 1,445,938 | A | * | 2/1923 | Farrington | 52/295 |
| 1,947,413 | A | * | 2/1934 | Hay | 249/1 |
| 2,103,246 | A | * | 12/1937 | Coustette | 52/297 |
| 2,664,739 | A | * | 1/1954 | Marcy | 52/474 |
| 2,948,995 | A | * | 8/1960 | Cogan | 52/259 |
| 3,605,105 | A | * | 9/1971 | Penzias | 343/839 |
| 3,630,474 | A | * | 12/1971 | Minor | 52/98 |
| 3,916,635 | A | * | 11/1975 | Lynch et al. | 405/253 |
| 3,918,229 | A | * | 11/1975 | Schweinberger | 52/295 |
| 4,199,277 | A | * | 4/1980 | Merjan | 405/251 |
| 4,200,906 | A | * | 4/1980 | Santilli | 362/431 |
| 4,228,627 | A | * | 10/1980 | O'Neill | 52/295 |
| 4,232,846 | A | * | 11/1980 | Bressani | 248/158 |
| 4,406,094 | A | * | 9/1983 | Hempel et al. | 52/40 |

(Continued)

FOREIGN PATENT DOCUMENTS

| | | |
|---|---|---|
| AU | 443598 | 1/1971 |

(Continued)

*Primary Examiner* — Robert Canfield
*Assistant Examiner* — Matthew Gitlin
(74) *Attorney, Agent, or Firm* — Knobbe Martens Olson & Bear LLP

(57) ABSTRACT

The present invention relates to a tower foundation system (30) comprising a foundation (32) for a bottom section (36) of a tower, which bottom section (36) is to be connected to the upper part of the foundation (32), wherein the bottom section (36) is cast into the foundation (32) with an ultra high performance grout (42).

17 Claims, 4 Drawing Sheets

U.S. PATENT DOCUMENTS

| | | | | | |
|---|---|---|---|---|---|
| 4,617,768 | A | * | 10/1986 | Gebelius | 52/40 |
| 4,673,157 | A | * | 6/1987 | Wells | 249/13 |
| 4,716,696 | A | | 1/1988 | Yacoboni | |
| 4,785,593 | A | | 11/1988 | Munoz, Jr. | |
| 4,918,891 | A | * | 4/1990 | Gerszewski | 52/295 |
| 5,050,356 | A | * | 9/1991 | Johnson et al. | 52/295 |
| 5,060,437 | A | * | 10/1991 | Parsons et al. | 52/298 |
| 5,257,489 | A | * | 11/1993 | Angelette | 52/295 |
| 5,271,203 | A | * | 12/1993 | Nagle | 52/834 |
| 5,505,033 | A | * | 4/1996 | Matsuo et al. | 52/296 |
| 5,533,835 | A | * | 7/1996 | Angelette | 405/229 |
| 5,586,417 | A | | 12/1996 | Henderson et al. | |
| 5,678,382 | A | * | 10/1997 | Naito | 52/745.21 |
| 5,689,927 | A | * | 11/1997 | Knight, Sr. | 52/297 |
| 5,752,349 | A | * | 5/1998 | Fitzsimmons et al. | 52/165 |
| 5,826,387 | A | | 10/1998 | Henderson et al. | |
| 6,358,603 | B1 | * | 3/2002 | Bache | 428/323 |
| 6,397,545 | B1 | * | 6/2002 | Fanucci et al. | 52/514 |
| 6,438,904 | B1 | * | 8/2002 | Anzai et al. | 52/167.1 |
| 6,588,717 | B2 | * | 7/2003 | Carnahan et al. | 248/188.8 |
| 6,808,350 | B1 | * | 10/2004 | Tooman et al. | 411/431 |
| 7,131,240 | B2 | * | 11/2006 | Simmons | 52/297 |
| 7,155,867 | B2 | * | 1/2007 | Saldarelli et al. | 52/292 |
| 7,191,569 | B2 | * | 3/2007 | Brown | 52/293.3 |
| 7,618,217 | B2 | * | 11/2009 | Henderson | 405/255 |
| 7,805,895 | B2 | * | 10/2010 | Kristensen | 52/169.9 |
| 8,037,646 | B2 | * | 10/2011 | Wobben | 52/126.3 |
| 8,051,627 | B2 | * | 11/2011 | Schiffer et al. | 52/854 |
| 2002/0124502 | A1 | * | 9/2002 | Henderson | 52/296 |
| 2002/0152695 | A1 | * | 10/2002 | Gilsdorf | 52/98 |
| 2003/0196393 | A1 | * | 10/2003 | Bowman et al. | 52/295 |
| 2004/0093818 | A1 | * | 5/2004 | Simmons | 52/295 |
| 2005/0252124 | A1 | * | 11/2005 | Bergman | 52/296 |
| 2006/0048471 | A1 | * | 3/2006 | Lee | 52/296 |
| 2007/0006541 | A1 | * | 1/2007 | Seidel | 52/292 |
| 2007/0251187 | A1 | * | 11/2007 | Schiffer et al. | 52/741.14 |
| 2008/0072511 | A1 | * | 3/2008 | Phuly | 52/294 |
| 2008/0302038 | A1 | * | 12/2008 | Wobben | 52/296 |
| 2009/0266026 | A1 | * | 10/2009 | Hannay et al. | 52/745.17 |

FOREIGN PATENT DOCUMENTS

| | | | |
|---|---|---|---|
| BE | 596016 | | 7/1958 |
| DE | 28 06 494 | | 8/1979 |
| DK | 117336 | | 4/1970 |
| EP | 0 518 777 | | 12/1992 |
| FR | 2 682 982 | | 10/1991 |
| FR | 2 665 915 | | 2/1992 |
| JP | 59233027 | A | 12/1984 |
| JP | 04083064 | A | 3/1992 |
| JP | 10131231 | | 5/1998 |
| JP | 11061854 | A | 3/1999 |
| JP | 2000328584 | A | 11/2000 |
| SU | 796312 | | 1/1981 |
| WO | WO 95/25213 | | 9/1995 |
| WO | WO 01/66861 | | 9/2001 |
| WO | WO 2004/101914 | A1 | 11/2004 |

* cited by examiner

TOWER FOUNDATION SYSTEM

CROSS REFERENCE TO RELATED APPLICATIONS

This application claims priority to and is a U.S. National Phase filing of PCT International Application Number PCT/DK2006/000152, filed on Mar. 16, 2006, designating the United States of America and published in the English language, which claims priority under 35 U.S.C. §119 to Denmark Patent Application Number PA 2005 00383, filed on Mar. 16, 2005. The disclosures of the above-described applications are hereby expressly incorporated by reference in their entireties.

FIELD OF THE INVENTION

The present invention relates to a tower foundation system for large, heavy and bulky towers such as wind turbine towers and steel chimneys, said system comprising a foundation and a bottom section of a tower, which bottom section is connected to the upper part of the foundation.

The invention relates to tower foundation systems in general. However, in the following a tower foundation system is described in relation to a wind turbine tower.

BACKGROUND OF THE INVENTION

Modern wind turbines tend to get bigger in order to produce more power. The length of the wings may exceed 60 m. and the height of the tower may exceed 100 m, thus increasing the load on the foundation tower holding the wind turbine.

Traditional tower foundations consist of a cast gravity foundation element provided with an embedded steel cylinder with a 300-500 mm flange at the bottom of steel cylinder for transferring the load from the steel cylinder to the concrete. A machined flange is arranged on top of the steel cylinder and is prepared for connection to a bottom section of the wind turbine tower. The steel cylinder is traditionally cast into the cast gravity foundation element with reinforcement elements protruding through the steel cylinder. The embedment depth of casting compared to the diameter of the steel cylinder need to have a certain value in order to ensure proper securing of the steel cylinder to the foundation, i.e. sufficient load transfer from the steel cylinder to the foundation.

To ensure that the tower foundation sustains the load and stress from the tower, the steel cylinder is cast deep into the gravity foundation to transfer the load to the foundation. The curing period of the standard concrete is long, and casting of the entire foundation comprising the embedded steel cylinder is complex and time consuming. Thus the costs of the foundation are relatively high compared to the total assembly costs of the wind turbine.

The steel cylinder having a top flange and a large bottom flange requires transportation to the wind turbine erection site, where it is to be embedded into the concrete gravity base. Logistically this is a challenge increasing the costs of the project.

OBJECT OF THE INVENTION

An object of the invention may be reducing transportation costs by eliminating the need for separate transport of the base cylinder to be embedded into the foundation.

Another object of the invention may be reducing tower assembly costs by eliminating the need for separate casting in the base cylinder to be embedded into the foundation.

Another object may be to eliminate costs of two heavy machined flanges and corresponding bolt assemblies, one from the bottom of the tower section and one form the embedded cylinder.

Furthermore, an object of the invention may be to provide a sufficiently durable and reliable method for providing a tower foundation system for large, heavy and bulky towers such as wind turbine towers and steel chimneys.

DESCRIPTION OF THE INVENTION

The objects of the invention is achieved by a foundation system comprising a circular, oval or polygonal recess (34) or plinth (55) in the upper part, that the foundation (32) is provided with reinforcement elements (44), which are protruding from the casting material of the foundation into the recess (34), and that the recess is intended for accommodating an ultra high performance grout (42) to be filled into the recess (34) or around the plinth.

The invention has the advantage that a sufficient load transfer is obtained with only a limited embedment depth compared to the diameter of the bottom section of the tower. As example, the ratio between the diameter D of the tower and the embedded depth h of the bottom section of the tower may be as high as 4 or even more. Other representative cross-sectional dimensions than a diameter may be selected if the bottom section of the tower does not have a circular cross-section.

The bottom section of the tower is directly connected to the foundation, thus there is no need to mount the bottom section onto a flange steel cylinder section or the like. This reduces assembly time and costs considerably, as the number of tower assemblies is reduced compared to prior art. By applying the present invention, the assembly between the steel cylinder and the bottom tower section is avoided.

According to an embodiment of the invention the foundation comprises a preferably circular or polygonal recess in the upper part of the foundation, which is prepared for receiving the bottom section of a tower. The bottom section is arranged into the recess, and cast into the foundation by filling the recess with an ultra high performance grout.

By applying the present invention the bottom section of the tower can be arranged directly into the recess of the foundation and then be cast to the foundation, thus it is no longer necessary to apply a separate steel cylinder that needs separate transportation and other separate handling and separate casting to the foundation. This is a great advantage, where transportation of big diameter steel cylinder is carried out by costly special transportation means. Thus, the present invention reduces transportation and other handling considerably.

Also, a ratio between a representative cross-sectional dimension of the bottom of the tower and the intended depth of embedment of the bottom of the tower into the recess of the foundation may be increased to at least 4, possibly at least 6, or even as high as at least 8. Thus, the length of bottom section of the tower being embedded is limited.

Depending on the cross-sectional geometry of the bottoms section of the tower, the representative cross-sectional dimension of the bottom section of the tower is a diameter of a tower having a circular cross-section, a major axis or a minor axis of a tower having an oval cross-section or a diagonal of a tower having a polygonal cross-section.

The bottom section of the tower is cast to the foundation by filling the recess with an ultra high performance grout. The grout hardening period is very short, thus the rest of the tower can be mounted after 24 hours. Furthermore, the grout is self-levelling and self-compacting, which means that there is no need to vibrate the grout to compact the grout etc. Hence, working hours and installation costs are reduced considerably.

The bottom section of the tower is arranged directly into the foundation recess, and thus there is no need to mount the bottom section onto a flange steel cylinder section or the like by means of bolts and nuts. This reduces assembly time and costs considerably, as the number of assemblies of each tower are reduced.

Each tower assembly consists of a great number of bolts and nuts having to be installed and tightened. By reducing the number of assemblies of each tower a great deal of difficult assembly work is avoided. Furthermore, re-torque and maintenance of the bolts and nuts between the steel cylinder and the bottom section is no longer necessary.

By using the ultra high performance grout there is no need for an embedded steel cylinder or the like to be arranged deep within the foundation in to order absorb and distribute the load and stress of the tower to the foundation. This is achieved as the ultra high performance grout, such as Ducorit®, which is much stronger than standard concrete used in prior art. The bottom flange of the embedded steel cylinder can also be reduced due to the relation between the compressive strength of the normal concrete and the ultra high performance grout. Ducorit® is characterized by extreme strength and stiffness, which makes the ultra high performance grout a strong structural component.

The ultra high performance grout is based on a binder consisting of cement and silicate. Simulations and tests show that the properties of the binder provided under the trademark Densit® by the company Densit A/S of Denmark is very suitable as binder in the ultra high performance grout. Densit® is extremely strong and dense.

The ultra high performance grout comprises of 30%-70% cement-based binder, which is mixed with aggregates such as quartz and/or bauxite and/or fibres. According to a preferred embodiment of the invention the ultra high performance grout is Ducorit®.

The main constituent of Ducorit® is a binder Densit® of the company Densit A/S of Denmark. Ducorit® is characterized by extreme strength and stiffness, which is developed during a very short hardening period, 50% of the final compressive strength being developed in 24 hours at 20° C. Usually, the strength gained after 24 hours is sufficient to continue the installation of the wind turbine. This means that all wind turbine supplies can be delivered and erected without interruption. Standard concrete normally needs 28 days to gain the necessary strength. Furthermore, Ducorit® products are pumpable and very easy to handle and cast.

Ducorit® comprises a binder Densit® of the company Densit A/S of Denmark and aggregates such as quartz or bauxite or fibres or any combination of quartz, bauxite and fibres. The aggregates are added to obtain the desired strength. Different Ducorit® varieties are presented in the table below. The differences between the products are the size and the amount of binder and aggregates—such as quartz or bauxite or fibres or any combination of quartz, bauxite and fibres. For instance, the aggregates in S1W consist of quartz aggregates that are smaller than 1 mm.

| | D4W Mean | S5W Mean | S1W Mean |
|---|---|---|---|
| Compressive strength [Mpa/Psi] | 210/30,400 | 130/18,850 | 110/16,000 |

The values presented in the table are mean values based on 75×75 mm cubes.

The ultra high performance grout applied has a compressive strength of between 75 MPa and 300 MPa, preferably of between 100 MPa and 250 MPa, possibly of between 75 MPa and 150 MPa, or possibly of between 150 MPa and 300 MPa. A compressive strength as stated is many times stronger than the compressive strength of the standard concrete used to connect the steel cylinder and the gravity foundation in prior art. It is important to note that the invention is not limited to the products mentioned above. Other ultra high performance grout products can be applied as well.

According to the invention the foundation is provided with reinforcement elements, which are protruding from the casting material of the foundation and upwards out of the casting material of the foundation. Reinforcing elements ensure that the load and stress from the tower are transferred and distributed from the recess of the foundation to the gravity foundation. Hence there is no need for a deep recess running from the upper part to the lower part of the foundation to transfer the load and stress from the tower.

According to an embodiment of the invention the reinforcement elements are arranged in the circumferential around the bottom section of the tower, and where the reinforcement elements are cast into the foundation and/or are cast into the recess of the foundation by the ultra high performance grout. Thus it is possible to construct a strong foundation designed for a particular load. The reinforcement elements are made of a material having the appropriate strength, preferably metal such as steel. Other materials such as fibre reinforced plastic materials or ceramic materials may be employed as well.

The objects of the invention is also achieved by a method for providing a tower foundation system, which method comprises the following steps of casting of the foundation with a circular, oval or polygonal recess or plinth in an upper part of the foundation, arranging reinforcing elements protruding from the casting material of the foundation into the recess or protruding around the plinth, hardening of the casting material of the foundation, arranging a bottom section of the tower in the recess or around the plinth, with the reinforcing elements encircling the bottom section or the bottom section encircling the reinforcement elements, casting the bottom section to the foundation by the ultra high performance grout being filled into the recess or being filled around the plinth, and hardening of the ultra high performance grout.

Firstly, the foundation is cast, which foundation according to a preferred embodiment of the invention consists of standard concrete, thus a hardening period is necessary to obtain the desired strength. A bottom section of the tower is subsequently arranged to the upper part of the foundation by a large crane or the like. The bottom section and the foundation are then cast together with the ultra high performance grout. Then follows a relatively short hardening period, which is necessary to build up the strength of the grout, so that the rest of the tower and the wind turbine can be assembled.

The method disclosed makes installation fast and efficient compared to prior art. Large wind turbines are often installed in a "wind turbine farm", where a great number of wind turbines are located inside a defined area. When erecting wind turbines of a wind turbine farm, the installation costs and the assembly time must be kept to a minimum. By using the method of the present invention it is possible to cast the foundation and erect the towers in a minimum of time. Furthermore, separate transportation of large steel cylinders for the foundation is no longer necessary.

The towers of modern wind turbines are very tall, thus a crane or perhaps even a helicopter is applied to lift the tower sections in place. When erecting and assembling a great number of wind turbines in a wind turbine farm, it is very important to schedule the use of the crane or helicopter in the most efficient way. Usually, the bottom tower section is relatively short but heavy, thus the crane or helicopter must be rigged for lifting the bottom section, whereas the crane or helicopter for the remaining lifts is rigged for high lifts. Therefore it is ideal to erect all the tower bases and subsequently rig the crane for higher lifts, thus preventing long periods of idleness.

According to an embodiment of the invention the tower foundation system comprises a preferably circular, oval or polygonal recess or plinth, which is implemented by the above mentioned method combined with the following steps of the foundation system being cast with reinforcement elements protruding from the casting material of the foundation into the recess or around the plinth, that a bottom section of the tower is arranged into the recess or around the plinth of the tower foundation system, and that the bottom section of the tower is cast into the foundation by filling the recess with or by filling around the plinth the ultra high performance grout so that the ultra high performance grout is cast in the recess or is cast around the plinth along the bottom of the tower and is cast in the recess or is cast around the plinth and furthermore is cast around the reinforcement elements. Firstly, the foundation is cast with a recess in the upper part. Secondly, the bottom section of the tower is arranged into the recess of the upper part of the foundation by a large crane or the like. Finally, the bottom section and the foundation are cast together by filling the recess with the ultra high performance grout.

The foundation is improved considerably by providing reinforcement elements during the casting of the foundation. The reinforcing elements improve the strength of the foundation and ensure transferring and distributing of the load and stress from the tower to the foundation.

According to the method steps according to the invention the reinforcement elements can be arranged and cast in the recess or around the plinth of the foundation and strengthen the foundation, but primarily assisting in transferring stress and load from the tower to the foundation via the ultra high performance grout.

At the end of the bottom section a small flange is fitted to transfer the load to the surrounding material. Compared to traditional embedded cylinders the flange can be much smaller due to the strength of the ultra high performance grout. The tower bottom section is placed into the recess, and the bottom flange is kept at a distance from the bottom of the recess by adjustable brackets to ensure that the ultra high performance grout serves as a cast support base to the bottom flange thus transferring vertical load to the concrete with normal compressive strength.

According to a preferred embodiment of the invention the recess is shaped as a ring grove, which is prepared for receiving a cylindrical bottom section of a tower.

According to another embodiment of the invention a traditional steel cylinder comprising a mounting flange is arranged in the recess of the foundation and fastened by an ultra high performance grout.

Hence the present invention can be applied for easy installation of a traditional steel cylinder. Furthermore, the time spent on installing the cylinder is reduced compared to prior art, as the hardening time of the ultra high performance grout is much shorter than the hardening time of standard concrete.

The above described method and tower foundation system is particularly efficient when applied in connection with a wind turbine tower. However, the method and tower foundation system also applies for other applications such as fixing of chimneys etc.

DESCRIPTION OF THE DRAWINGS

In the following the invention is described with reference to the drawings where.

DETAILED DESCRIPTION OF THE INVENTION

Figure 1:
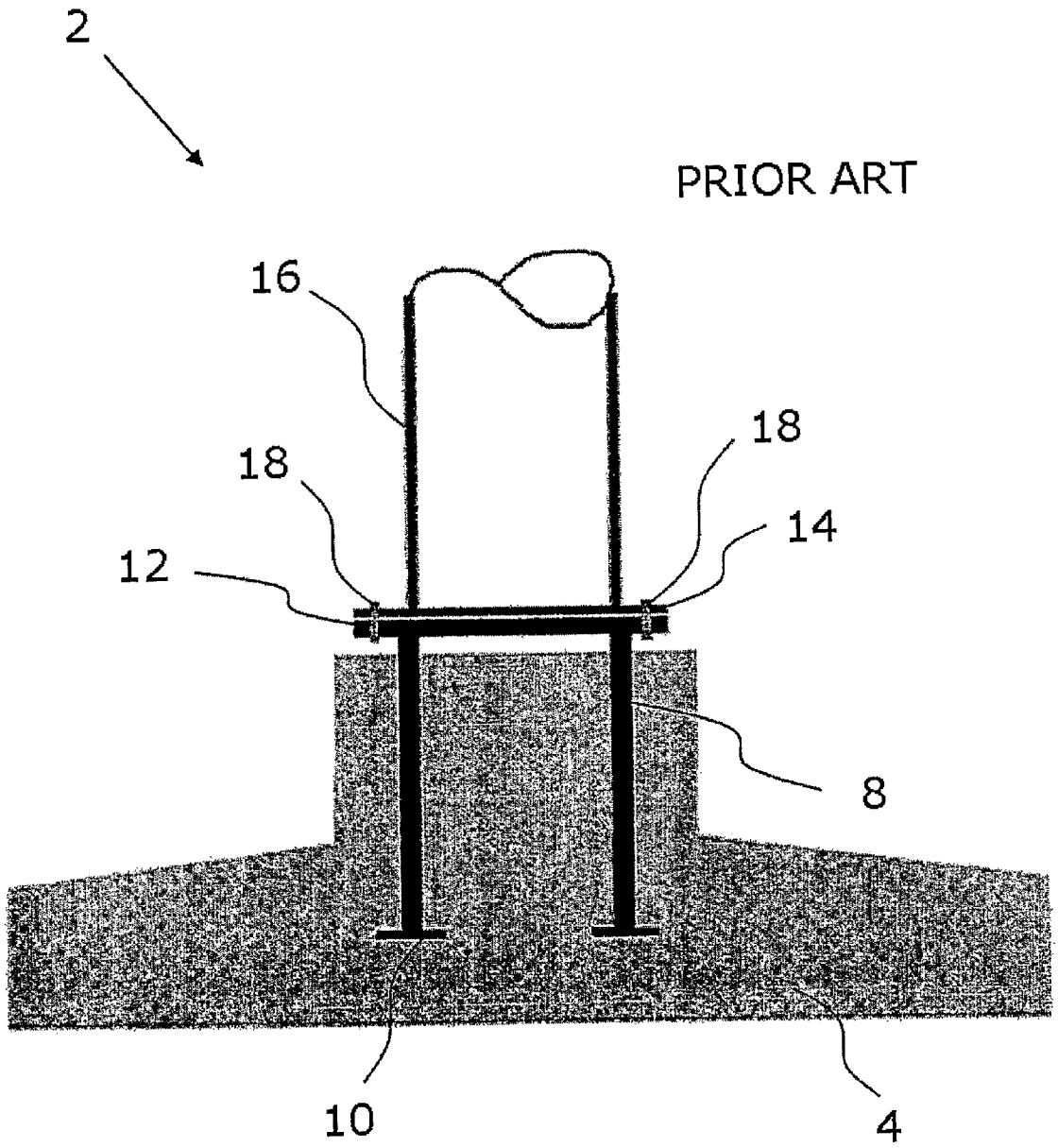
FIG. 1 shows a tower foundation system according to prior art.

FIG. 1 shows a tower foundation system 2 according to prior art. The tower foundation system comprises of a cast gravity foundation element 4 with an embedded steel cylinder 8 with a 300-500 mm flange 10 at the bottom in order to transfer the load to the concrete. A machined flange 12 is arranged on top of the steel cylinder 8 and is prepared for connection with a corresponding machined flange 14 of bottom section 16 of a wind turbine tower. The steel cylinder 8 is traditionally cast into the cast gravity foundation element 4. To ensure that the tower foundation sustains the load and stress from the tower, the steel cylinder 8 must be cast deep into the cast gravity foundation element 4 to absorb the load. The bottom section 16 of a wind turbine tower is fastened to the steel cylinder 8 by a great number of bolts 18.

Figure 2:
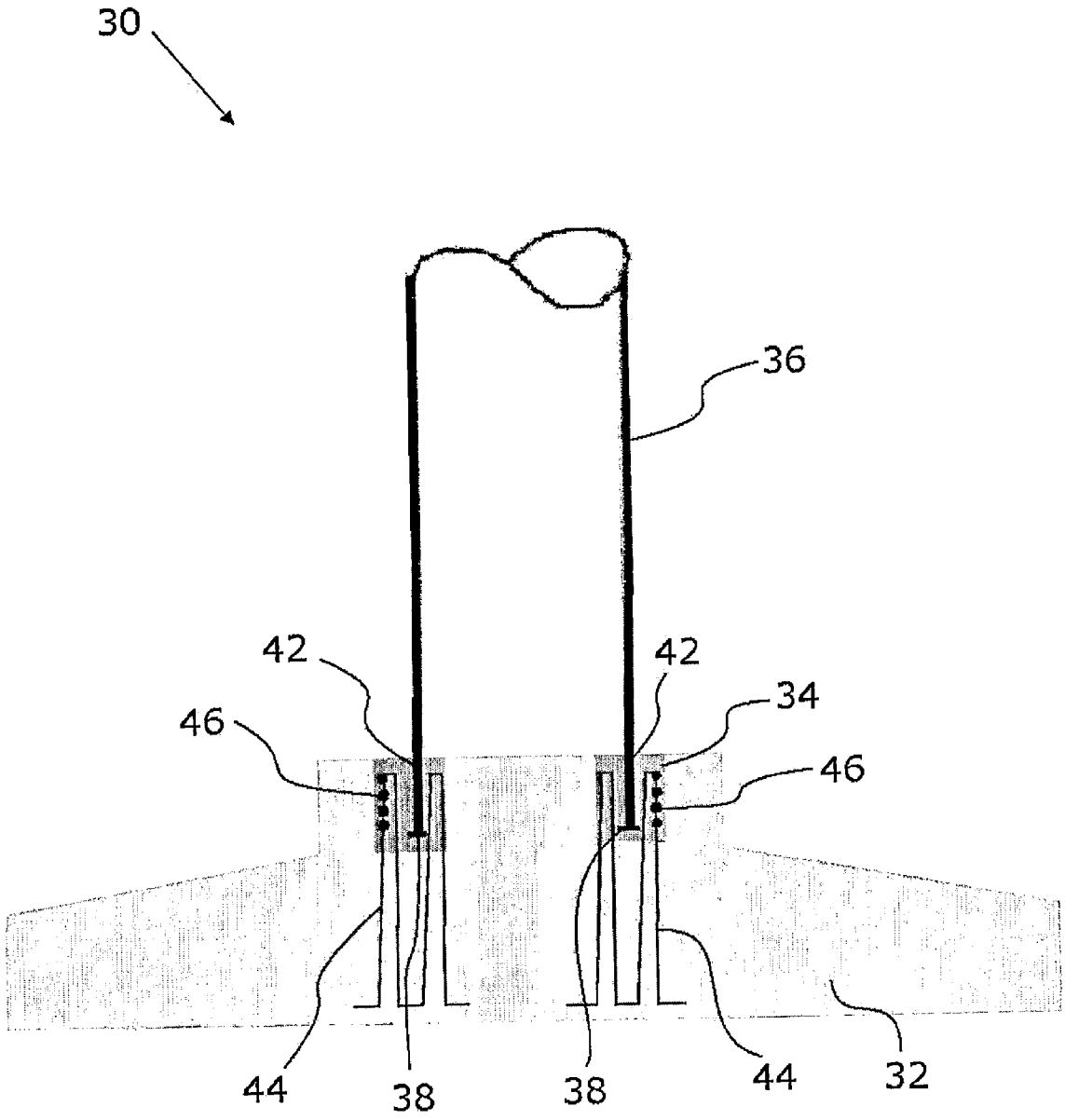
FIG. 2 shows a tower foundation system according to the present invention.

FIG. 2 shows a tower foundation system 30 according to the present invention. The tower foundation system 30 comprises a cast gravity foundation 32 with a circular recess 34. A bottom section 36 of a wind turbine tower is arranged in the circular recess 34 of the cast gravity foundation. The circular recess 34 is filled with an ultra high performance grout 42, such as Ducorit®. The bottom section 36 has a flange end 38, which interacts with the ultra high performance grout 42

The tower foundation system 30 comprises a reinforcement element 44, which protrudes into the circular recess 34 of the cast gravity foundation 32. Furthermore, a number of reinforcement elements 46 are arranged around the bottom section 36 in order to transfer and distribute the load and stress from the bottom section 36 to the bottom of the cast gravity foundation 32.

A flange (not shown) is mounted on top of the bottom section 36 for connection with another tower section (not shown). According to the present invention a tower assembly is avoided between the bottom section 16 and the steel cylinder 8 shown in FIG. 2.

According to an alternative embodiment of the invention the bottom section 36 is arranged into the circular recess 34, which is partly filled with the ultra high performance grout (not shown).

Figure 3:
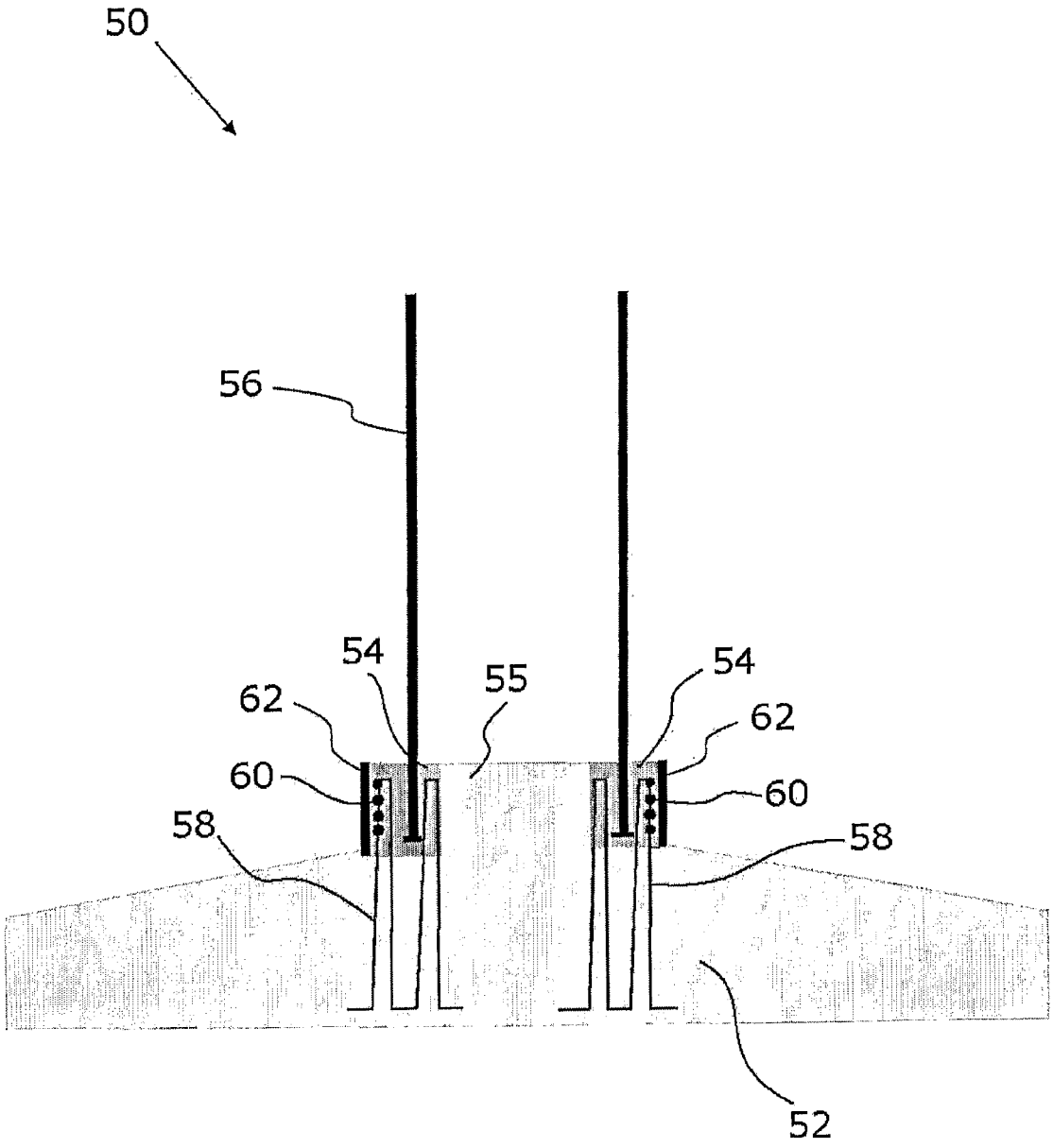
FIG. 3 shows an alternative embodiment of the tower foundation system.

FIG. 3 shows an embodiment of the tower foundation system 50 comprising a foundation element 52 and a bottom section 56 of a tower, which is arranged in a circular recess 54 formed by the circular plinth 55 of the concrete base 52. The figure shows an outside mould 62 that is circumferentially arranged around the plinth 55. The ultra high performance grout filled into the circular recess 54, thereby connecting the tower bottom section 56 to the foundation element 52.

Reinforcement elements 58 are protruding into the recess 54 filled with ultra high performance grout to transfer and distribute the load and stress from the bottom section 56 to the foundation element 52. Ring reinforcement 60 is cast into the recess 54.

Figure 4:
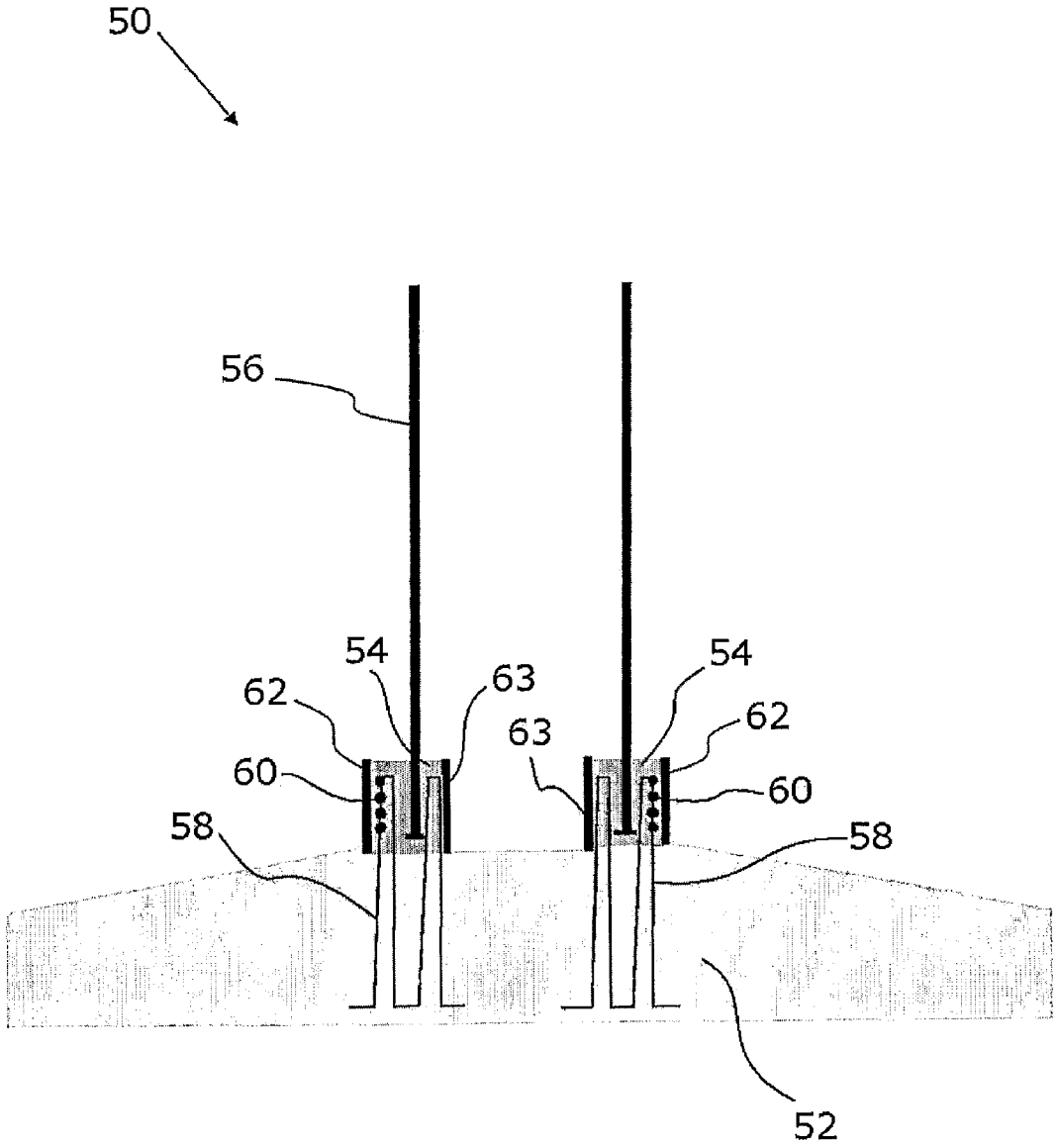
FIG. 4 shows an even alternative embodiment of the tower foundation system.

FIG. 4 shows an embodiment of the tower foundation system 50 also comprising a foundation element 52 and a bottom section 56 of a tower, which is arranged in a circular recess 54 formed by the circular plinth 55 of the concrete base 52. The figure shows both an outside mould 62 that is circumferentially arranged, and an inside mounted mould 63 substituting the plinth 55 shown in FIG. 3. The ultra high performance grout filled into the bottom section of the tower and also into the circular recess 54, thereby connecting the tower bottom section 56 to the foundation element 52.

Reinforcement elements 58 are protruding into the recess 54 filled with ultra high performance grout to transfer and distribute the load and stress from the bottom section 56 to the foundation element 52. Ring reinforcement 60 is cast into the recess 54.

The invention claimed is:

1. A tower foundation system comprising:

a cast foundation configured to secure a bottom section of a tower, which bottom section is connected to an upper part of the foundation, wherein the foundation comprises:

a circular, oval or polygonal plinth in the upper part of the foundation, wherein the bottom section of the tower is arranged around the plinth;

a circular, oval or polygonal mould at the upper part of the foundation, said mould circumferentially arranged around the plinth, a recess formed by the plinth and the mould, and at least one reinforcing element extending from a casting material of the foundation and around the plinth with the reinforcing elements encircling the plinth, wherein the plinth accommodates an ultra high performance grout around said plinth, said ultra high performance grout being filled into said recess, thereby connecting the bottom section of the tower to the foundation.

2. The tower foundation system according to claim 1, wherein the ultra high performance grout comprises a cement-based binder.

3. The tower foundation system according to claim 2, wherein the ultra high performance grout consists of a 30%-70% cement-based binder, which is mixed with an aggregate.

4. The tower foundation system according to claim 3, wherein said aggregate contains quartz, bauxite or fibres.

5. The tower foundation system according to claim 1, wherein the ultra high performance grout has a compressive strength of 75-300 MPa.

6. The tower foundation system according to claim 1, wherein the ultra high performance grout has a compressive strength of 100-250 Mpa.

7. The tower foundation system according claim 1, wherein the ultra high performance grout has a compressive strength of 75-150 Mpa.

8. The tower foundation system according to claim 1, wherein the ultra high performance grout has a compressive strength of 150-300 Mpa.

9. The tower foundation system according to claim 1, wherein the ratio between a representative cross-sectional dimension of the bottom of the tower and the intended depth of embedment of the bottom of the tower into the recess of the foundation is at least 4.

10. The tower foundation system according to claim 9, wherein the ratio between a representative cross-sectional dimension of the bottom of the tower and the intended depth of embedment of the bottom of the tower into the recess of the foundation is at least 6.

11. The tower foundation system according to claim 10, wherein the ratio between a representative cross-sectional dimension of the bottom of the tower and the intended depth of embedment of the bottom of the tower into the recess of the foundation is at least 8.

12. The tower foundation system according to claim 9, wherein the representative cross-sectional dimension is a diameter of a tower having a circular cross-section.

13. The tower foundation system according to claim 9, wherein the representative cross-sectional dimension is a major axis of a tower having an oval cross-section.

14. The tower foundation system according to claim 9, wherein the representative cross-sectional dimension is a minor axis of a tower having an oval cross-section.

15. The tower foundation system according to claim 9, wherein the representative cross-sectional dimension is a diagonal of a tower having a polygonal cross-section.

16. The tower foundation system according to claim 1, wherein the reinforcement elements are arranged around the plinth along a circumference that is greater than the circumference of the bottom section of the tower, which the tower foundation system is intended for securing.

17. The tower foundation system according to claim 1, wherein the reinforcement elements are arranged around the plinth along a circumference that is smaller than the circumference of the bottom section of the tower, which the tower foundation system is intended for securing.

* * * * *

UNITED STATES PATENT AND TRADEMARK OFFICE

CERTIFICATE OF CORRECTION

PATENT NO. : 8,261,502 B2
APPLICATION NO. : 11/908569
DATED : September 11, 2012
INVENTOR(S) : Anders Moller Andersen It is certified that error appears in the above-identified patent and that said Letters Patent is hereby corrected as shown below:

In the Specifications:

At Column 6, Line 38, Change "42" to --42.--.

In the Claims:

At Column 8, Line 4, In Claim 7, change "according" to --according to--.

Signed and Sealed this
Twenty-first Day of May, 2013

Teresa Stanek Rea
*Acting Director of the United States Patent and Trademark Office*